US007861728B2

(12) United States Patent
Holton, Jr. et al.

(10) Patent No.: US 7,861,728 B2
(45) **Date of Patent: *Jan. 4, 2011**

(54) SMOKELESS TOBACCO COMPOSITION HAVING AN OUTER AND INNER POUCH

(75) Inventors: Darrell Eugene Holton, Jr., Clemmons, NC (US); Daniel Verdin Cantrell, Lewisville, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 343 days.

This patent is subject to a terminal disclaimer.

(21) Appl. No.: 11/351,919

(22) Filed: Feb. 10, 2006

(65) Prior Publication Data

US 2007/0186941 A1 Aug. 16, 2007

(51) Int. Cl.
*A24B 15/00* (2006.01)
*A24B 3/14* (2006.01)
*A24B 15/12* (2006.01)

(52) U.S. Cl. ..... 131/352; 131/353; 131/356

(58) Field of Classification Search ..... 131/352; 426/89, 98, 99, 102–103
See application file for complete search history.

(56) References Cited

U.S. PATENT DOCUMENTS

| | | | |
|---|---|---|---|
| 1,376,586 | A | 5/1921 | Schwartz |
| 3,339,558 | A | 9/1967 | Waterbury |
| 3,390,686 | A | 7/1968 | Irby et al. |
| 3,550,598 | A | 12/1970 | McGlumphy et al. |
| 3,685,521 | A | 8/1972 | Dock |
| 3,916,914 | A | 11/1975 | Brooks et al. |
| 4,148,325 | A | 4/1979 | Solomon et al. |
| 4,513,756 | A | 4/1985 | Pittman et al. |
| 4,528,993 | A | 7/1985 | Sensabaugh, Jr. et al. |
| 4,607,479 | A | 8/1986 | Linden |

(Continued)

FOREIGN PATENT DOCUMENTS

| | | |
|---|---|---|
| JP | 1-108966 | 4/1989 |

(Continued)

OTHER PUBLICATIONS

U.S. Appl. No. 11/233,399, filed Sep. 2005, Holton et al.*

*Primary Examiner*—Matthew J. Daniels
*Assistant Examiner*—Jodi Cohen
(74) *Attorney, Agent, or Firm*—Brinks Hofer Gilson & Lione

(57) ABSTRACT

A smokeless tobacco product includes a powdered or granular smokeless tobacco formulation that is contained within a moisture-permeable packet or pouch. The smokeless tobacco formulation may include finely ground particles of tobacco in powder-like form and other ingredients such as sweeteners, binders, colorants, pH adjusters, fillers, flavoring ingredients, disintegration aids, antioxidants and preservatives. The tobacco formulation may have a dry or moist form. The container has the form of a pouch or bag, such as is the type commonly used for the manufacture of snus products. The container preferably contains at least one capsule, such as a spherical breakable capsule. The container is intended to be placed in the mouth of the tobacco user, such that the tobacco formulation within the container may be enjoyed by the user. After the tobacco user is finished using the smokeless tobacco product, the container is removed from the user's mouth for disposal. Alternatively, the container is dissolvable or dispersible in the mouth of the user.

18 Claims, 2 Drawing Sheets

U.S. PATENT DOCUMENTS

| | | | | | |
|---|---|---|---|---|---|
| 4,624,269 | A | | 11/1986 | Story et al. | |
| 4,631,899 | A | | 12/1986 | Nielsen | |
| 4,660,577 | A | | 4/1987 | Sensabaugh et al. | |
| 4,889,144 | A | | 12/1989 | Tateno et al. | |
| 4,987,907 | A | * | 1/1991 | Townend | 131/352 |
| 5,046,514 | A | * | 9/1991 | Bolt | 131/359 |
| 5,092,352 | A | * | 3/1992 | Sprinkle et al. | 131/352 |
| 5,167,244 | A | * | 12/1992 | Kjerstad | 131/359 |
| 5,223,185 | A | | 6/1993 | Takei et al. | |
| 5,346,734 | A | | 9/1994 | Wydick, Jr. | |
| 5,387,093 | A | | 2/1995 | Takei | |
| 5,387,416 | A | | 2/1995 | White et al. | |
| 5,882,680 | A | | 3/1999 | Suzuki et al. | |
| 6,117,455 | A | | 9/2000 | Takada et al. | |
| 6,162,516 | A | | 12/2000 | Derr | |
| 6,325,859 | B1 | * | 12/2001 | De Roos et al. | 131/276 |
| 6,510,855 | B1 | | 1/2003 | Korte et al. | |
| 6,631,722 | B2 | | 10/2003 | MacAdam et al. | |
| 6,719,933 | B2 | | 4/2004 | Nakamura et al. | |
| 6,730,832 | B1 | | 5/2004 | Dominguez et al. | |
| 6,834,654 | B2 | * | 12/2004 | Williams | 131/352 |
| 6,887,307 | B1 | | 5/2005 | Scott et al. | |
| 6,923,981 | B2 | | 8/2005 | Leung et al. | |
| 6,949,256 | B2 | | 9/2005 | Fonkwe et al. | |
| 7,229,658 | B1 | * | 6/2007 | Inoue et al. | 426/548 |
| 2002/0117180 | A1 | * | 8/2002 | Hersh et al. | 131/359 |
| 2003/0070687 | A1 | * | 4/2003 | Atchley et al. | 131/352 |
| 2003/0159702 | A1 | * | 8/2003 | Lindell et al. | 131/270 |
| 2004/0020503 | A1 | * | 2/2004 | Williams | 131/352 |
| 2004/0084056 | A1 | | 5/2004 | Lawson et al. | |
| 2004/0097549 | A1 | * | 5/2004 | Keane et al. | 514/317 |
| 2004/0118421 | A1 | * | 6/2004 | Hodin et al. | 131/352 |
| 2004/0118422 | A1 | | 6/2004 | Lundin et al. | |
| 2004/0224020 | A1 | | 11/2004 | Schoenhard | |
| 2004/0261807 | A1 | | 12/2004 | Dube et al. | |
| 2005/0061339 | A1 | | 3/2005 | Hansson et al. | |
| 2005/0123601 | A1 | | 6/2005 | Mane et al. | |
| 2005/0196437 | A1 | | 9/2005 | Bednarz et al. | |
| 2005/0244521 | A1 | * | 11/2005 | Strickland et al. | 424/751 |
| 2005/0249676 | A1 | | 11/2005 | Scott et al. | |
| 2006/0191548 | A1 | * | 8/2006 | Strickland et al. | 131/347 |
| 2008/0029110 | A1 | * | 2/2008 | Dube et al. | 131/275 |
| 2008/0029116 | A1 | * | 2/2008 | Robinson et al. | 131/352 |
| 2008/0029117 | A1 | * | 2/2008 | Mua et al. | 131/352 |
| 2008/0173317 | A1 | * | 7/2008 | Robinson et al. | 131/112 |

FOREIGN PATENT DOCUMENTS

| | | | | |
|---|---|---|---|---|
| WO | WO 98/15191 | | | 4/1998 |
| WO | WO 02/080707 | A1 | | 10/2002 |
| WO | WO 02/087365 | | * | 11/2002 |
| WO | WO 02/087365 | A1 | | 11/2002 |
| WO | WO 03/009711 | A1 | | 2/2003 |
| WO | WO 03/028492 | A1 | | 4/2003 |
| WO | WO 03/053175 | A2 | | 7/2003 |
| WO | WO 03053175 | | * | 7/2003 |
| WO | WO 2004/095959 | A1 | | 11/2004 |
| WO | WO 2005/004480 | A1 | | 1/2005 |
| WO | WO 2005/041699 | A2 | | 5/2005 |
| WO | WO 2005046363 | | * | 5/2005 |
| WO | WO 2005046363 | A2 | * | 5/2005 |
| WO | WO 2005/063060 | A1 | | 7/2005 |

* cited by examiner

SMOKELESS TOBACCO COMPOSITION HAVING AN OUTER AND INNER POUCH

FIELD OF THE INVENTION

The present invention relates to tobacco, and in particular, to the use of tobacco in a smokeless form.

BACKGROUND OF THE INVENTION

Cigarettes, cigars and pipes are popular smoking articles that employ tobacco in various forms. Such smoking articles are used by heating or burning tobacco, and aerosol (e.g., smoke) is inhaled by the smoker. Tobacco also may be enjoyed in a so-called "smokeless" form. Particularly popular smokeless tobacco products are employed by inserting some form of processed tobacco or tobacco-containing formulation into the mouth of the user.

Various types of smokeless tobacco products are set forth in U.S. Pat. No. 1,376,586 to Schwartz; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,987,907 to Townsend; U.S. Pat. No. 5,092,352 to Sprinkle, III et al.; and U.S. Pat. No. 5,387,416 to White et al.; U.S. Pat. App. Pub. No. 2005/0244521 to Strickland et al.; PCT Application Pub. No. WO 04/095959 to Arnarp et al.; PCT Application Pub. No. WO 05/063060 to Atchley et al. and PCT Application Pub. No. WO 05/004480 to Engstrom; each of which is incorporated herein by reference. One type of smokeless tobacco product is referred to as "snuff." Representative types of moist snuff products, commonly referred to as "snus," are manufactured in Europe, particularly in Sweden, by or through companies such as Swedish Match AB, Fiedler & Lundgren AB, Gustavus AB, Skandinavisk Tobakskompagni A/S and Rocker Production AB. Representative smokeless tobacco products also are marketed under the tradenames Oliver Twist by House of Oliver Twist A/S; Copenhagen, Skoal, Rooster, Red Seal, Husky, and Revel by U.S. Smokeless Tobacco Co.; and Levi Garrett, Peachy, Taylor's Pride, Kodiak, Hawken Wintergreen, Grizzly, Dental, Kentucky King, and Mammoth Cave by Conwood Sales Co., L.P.

It would be desirable to provide an enjoyable form of a smokeless tobacco product.

SUMMARY OF THE INVENTION

The present invention relates to a smokeless tobacco product. The product includes a powdered or granular smokeless tobacco formulation that is disposed within a moisture-permeable container. The smokeless tobacco formulation includes granular particles of tobacco, and may include other ingredients, such as sweeteners, binders, colorants, pH adjusters, fillers, flavoring agents, disintegration aids, antioxidants, and preservatives. The moisture content of the particles of the tobacco may vary. Also disposed within the container is at least one flavor agent member, such as a liquid filled capsule and/or a flavor sheet. A representative capsule embodiment is generally spherical in shape, and has an outer cover or shell that contains a liquid center region. The liquid center region, which is released when the outer shell undergoes some type of physical destruction, breakage, or other loss of physical integrity (e.g., through dispersion, softening, crushing, application of pressure, or the like), thereby provides for altering the sensory properties of the smokeless tobacco product. The outermost container preferably has the form of a pouch or bag, such as is the type commonly used for the manufacture of snus types of products.

The container is intended to be placed in the mouth of the tobacco user, such that the tobacco formulation within the container may be enjoyed by the user. During use of the product, the outer shell of the capsule within the container may be acted upon by moisture within the mouth of the user, broken, crushed, or otherwise acted upon to release its contents. After the tobacco user is finished using the smokeless tobacco product, the container may be removed from the user's mouth for disposal. Alternatively, the container may be manufactured from a water dissolvable or dispersible material, such that the tobacco formulation and the container may be ingested by the user. Residual components of the outer shell of the capsule may be dispersed within the mouth of the user for ingestion, or remain within the used container for disposal.

BRIEF DESCRIPTION OF THE DRAWINGS

In order to provide an understanding of embodiments of the invention, reference is made to the appended drawings, in which reference numerals refer to components of described exemplary embodiments of the invention. The drawings are exemplary only, and should not be construed as limiting the invention.

DETAILED DESCRIPTION OF THE PREFERRED EMBODIMENTS

Figure 1:
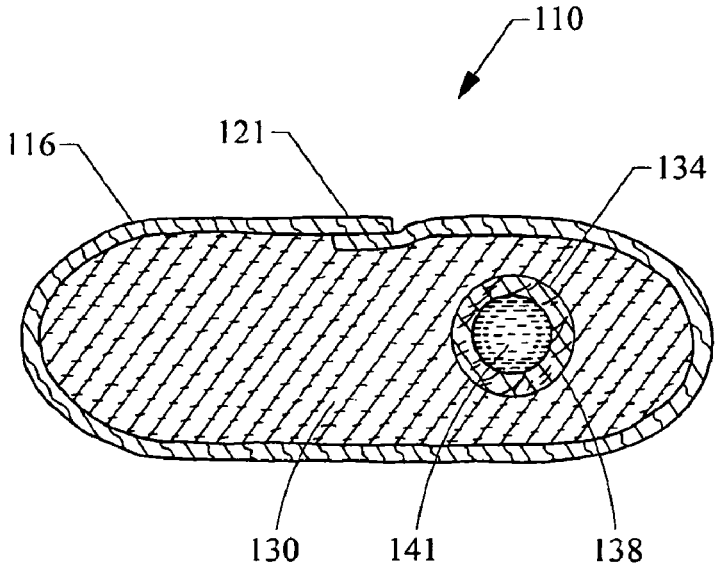
FIG. 1 is a cross-sectional view of a first smokeless tobacco product embodiment, taken across the width of the product, showing an outer mesh pouch, tobacco material contained within the pouch, and a spherical capsule (also shown in cross-section) that is contained within the pouch.

Referring to FIG. 1, there is shown a first embodiment of a smokeless tobacco product 110. The tobacco product 110 includes a container pouch 116. A preferred container comprises a moisture permeable mesh material. The illustrated container pouch 116 is sealed closed along its length along an overlap region 121. The overlap region may be formed by sealing the bottom portion of one edge of the container material 116 over the top portion of the opposite edge of the container material (e.g., by heat sealing, suitable adhesive, or other suitable means). A granular tobacco material 130 is disposed within the pouch 116. Also disposed within the pouch 116 is a spherical capsule 134. The spherical capsule 134 has an outer shell 138 that contains an inner payload 141. During a preferred use of the smokeless tobacco product 110, the capsule 134 is ruptured and its contents 141 are dispersed within the granular tobacco material 130 within the pouch 116.

Figure 2:
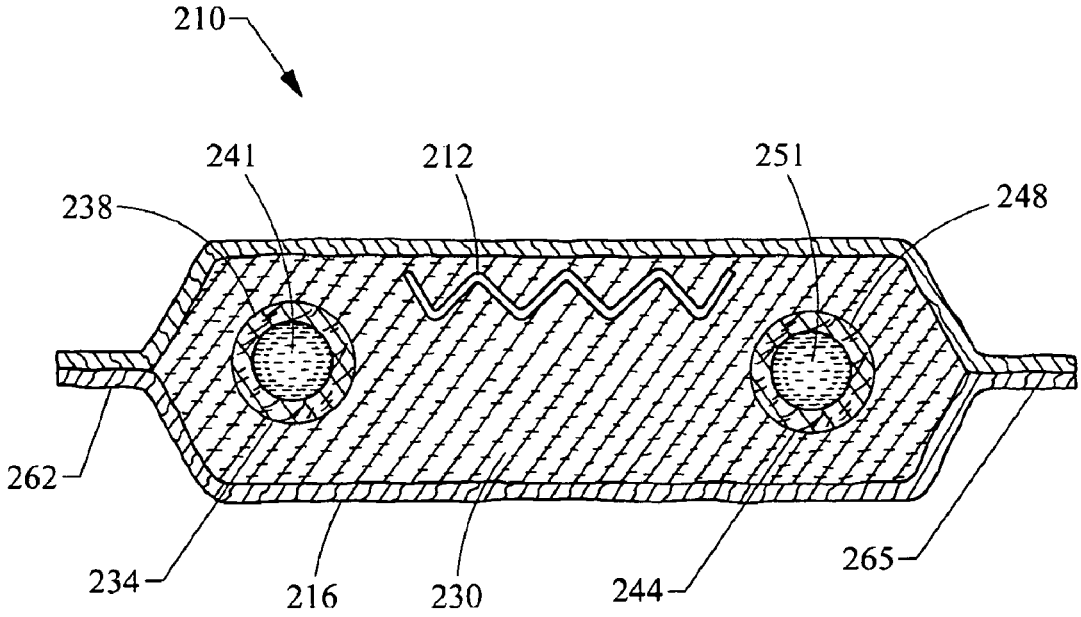
FIG. 2 is a cross-sectional view of a second smokeless tobacco product embodiment, taken across the length of the product, showing an outer mesh pouch and tobacco material, a flavor sheet, and two spherical capsules (also shown in cross-section) that are contained within the pouch.

Referring to FIG. 2, there is shown a second embodiment of a smokeless tobacco product 210. The tobacco product 210 includes a container pouch 216. A preferred container comprises a moisture permeable mesh material. The illustrated container pouch 216 is sealed shut at its ends 262, 265 (e.g., by heat-sealing, a suitable adhesive, or other suitable sealing means). A granular tobacco material 230 is contained within the pouch 216. Also contained within the pouch 216 are two spherical capsules 234 and 244. Each of the spherical capsules 234, 244 has an outer shell 238, 248 that contains an inner payload 241, 251. A dissolvable strip of a flavored material, shown as a flavor sheet 212 is included in the pouch as well. In certain alternative embodiments, a strip of flavored material such as the flavor sheet 212 may be disposed in a pouch 216 without a capsule being present. The capsule payload 241, 251 preferably is a flavor-containing liquid, as is described below in greater detail.

Figure 3:
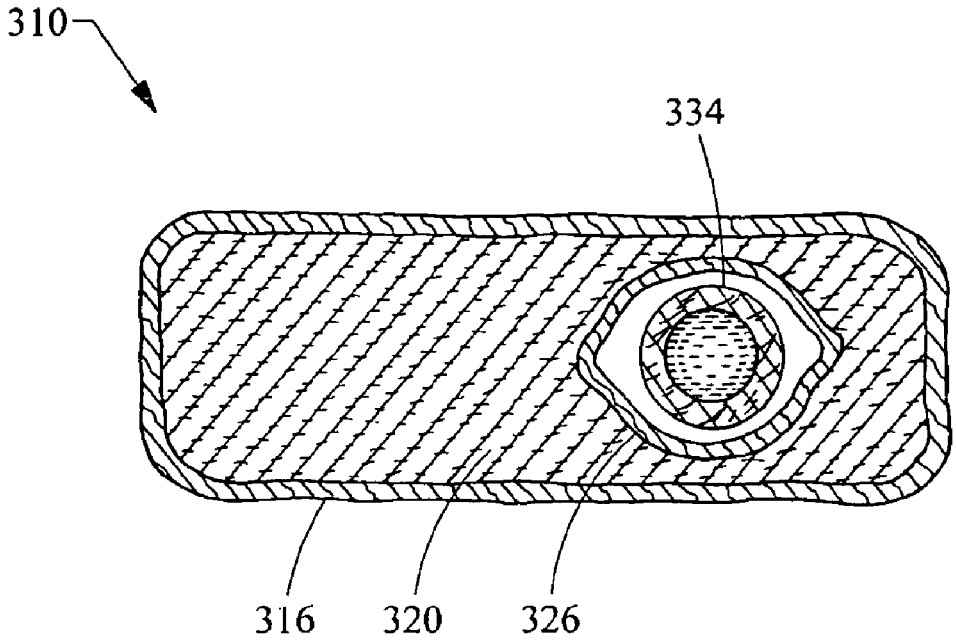
FIG. 3 is a cross-sectional view of a third smokeless tobacco product embodiment, taken across the length of the product, showing an outer pouch, an inner pouch, and tobacco material, with a capsule contained in the inner pouch.

Referring to FIG. 3, there is shown a third embodiment of a smokeless tobacco product 310. The tobacco product 310 includes an outer pouch 316 and an inner pouch 326. Preferred pouches each comprise a moisture permeable mesh material, and the pouches 316, 326 are illustrated without showing a seam that may be present. The outer pouch 316 forms a continuous container around a tobacco material 320. The inner pouch 326 is disposed within the outer pouch 316 and is generally surrounded by the tobacco material 320, although the inner pouch 326 may also be in contact with, adhered to, or formed continuously with the outer pouch 316. The inner pouch 326 contains a liquid-core, flavorant-containing capsule 334. Although the inner pouch 326 is shown with interior space surrounding the capsule 334 for purposes of clarity in illustration, in preferred aspects of this embodiment the inner pouch 334 will be closely fitted around its contents. In an alternative embodiment, the inner pouch may contain a flavor strip such as a dissolvable flavor strip (for example, a Cinnamon Oral Care Strip available in Listerine PocketPaks from Pfizer, Inc.).

Figure 4:
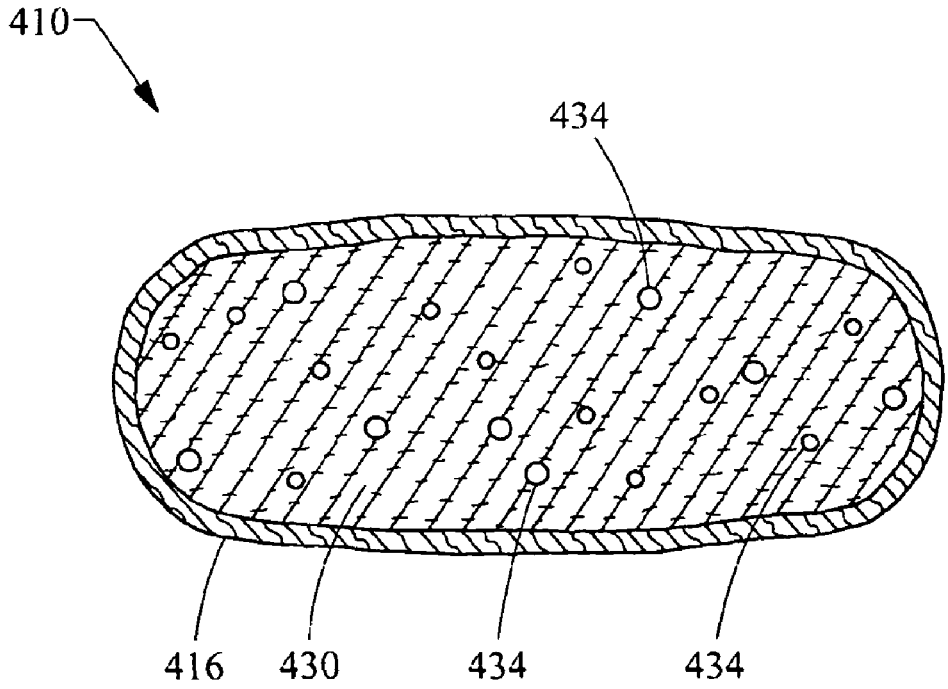
FIG. 4 is a cross-sectional view of a fourth smokeless tobacco product embodiment, taken across the width of the product, showing an outer pouch, filled with tobacco material, and microcapsules disposed in the tobacco material.

Referring to FIG. 4, there is shown a fourth embodiment of a smokeless tobacco product 410. The tobacco product 410 includes a seamless container pouch 416. A preferred container pouch 416 comprises a moisture permeable mesh material. A granular tobacco material 430 is disposed within the pouch 416. Also contained within the pouch 416 is a plurality of microcapsules 434 (not shown to scale). The microcapsules 434 may be of uniform or varied size and preferably comprise one or more flavoring ingredients, such as are described in greater detail below.

Tobaccos used for the manufacture of tobacco products pursuant to the present invention may vary. The tobaccos may include types of tobaccos such as flue-cured tobacco, burley tobacco, Oriental tobacco, Maryland tobacco, dark tobacco, dark-fired tobacco and Rustica tobaccos, as well as other rare or specialty tobaccos. Descriptions of various types of tobaccos, growing practices, harvesting practices and curing practices are set forth in *Tobacco Production, Chemistry and Technology*, Davis et al. (Eds.) (1999), which is incorporated herein by reference. See, also, the types of tobaccos that are set forth in U.S. Pat. No. 4,660,577 to Sensabaugh, Jr. et al.; U.S. Pat. No. 5,387,416 to White et al. and U.S. Pat. No. 6,730,832 to Dominguez et al.; and U.S. Pat. App. Pub. No. 2004/0084056 to Lawson et al., each of which is incorporated herein by reference. Most preferably, the tobacco materials are those that have been appropriately cured and aged. Especially preferred techniques and conditions for curing flue-cured tobacco are set forth in Nestor et al., Beitrage Tabakforsch. Int., 20 (2003) 467-475 and U.S. Pat. No. 6,895,974 to Peele, which are incorporated herein by reference. Representative techniques and conditions for air curing tobacco are set forth in Roton et al., Beitrage Tabakforsch. Int., 21 (2005) 305-320 and Staaf et al., Beitrage Tabakforsch. Int., 21 (2005) 321-330, which are incorporated herein by reference.

Tobacco products of the present invention, such as the embodiments illustrated in FIGS. 1-4, may incorporate one type of tobacco (e.g., in a so-called "straight grade" form). For example, the tobacco within a tobacco product may be composed solely of flue-cured tobacco (e.g., all of the tobacco may be composed, or derived from, either flue-cured tobacco lamina or a mixture of flue-cured tobacco lamina and flue-cured tobacco stem). The tobacco within a tobacco product also may have a so-called "blended" form. For example, the tobacco within a tobacco product may be composed of a mixture of parts or pieces of flue-cured, burley (e.g., Malawi burley tobacco) and Oriental tobaccos (e.g., as tobacco composed of, or derived from, tobacco lamina, or a mixture of tobacco lamina and tobacco stem). For example, a representative blend may incorporate about 30 to about 70 parts burley tobacco (e.g., lamina, or lamina and stem), and about 30 to about 70 parts flue cured tobacco (e.g., stem, lamina, or lamina and stem) on a dry weight basis. Other exemplary tobacco blends incorporate about 75 parts flue-cured tobacco, about 15 parts burley tobacco and about 10 parts Oriental tobacco; or about 65 parts flue-cured tobacco, about 25 parts burley tobacco and about 10 parts Oriental tobacco; or about 65 parts flue-cured tobacco, about 10 parts burley tobacco and about 25 parts Oriental tobacco; on a dry weight basis.

The tobacco that is used for the tobacco product most preferably includes tobacco lamina, or tobacco lamina and stem mixture. Tobacco mixtures incorporating a predominant amount of tobacco lamina, relative to tobacco stem, are preferred. Most preferably, the tobacco lamina and stem are used in an unextracted form, that is, such that the extractable portion (e.g., the water soluble portion) is present within the unextractable portion (e.g., the tobacco pulp) in a manner comparable to that of natural tobacco provided in a cured and aged form. Most preferably, the tobacco is not provided in a reconstituted form, extruded form, or any form that has resulted from extraction and recombination of components of that tobacco. However, portions of the tobaccos within the tobacco product may have processed forms, such as processed tobacco stems (e.g., cut-rolled stems, cut-rolled-expanded stems or cut-puffed stems), or volume expanded tobacco (e.g., puffed tobacco, such as dry ice expanded tobacco (DIET)). In addition, the tobacco product optionally may incorporate tobacco that has been fermented. See, also, the types of tobacco processing techniques set forth in PCT Application Pub. No. WO 05/063060 to Atchley et al., which is incorporated herein by reference.

The tobacco used for the manufacture of the tobacco product preferably is provided in a shredded, ground, granulated, fine particulate or powder form. Most preferably, the tobacco is employed in the form of parts or pieces that have an average particle size less than that of the parts or pieces of shredded tobacco used in so-called "fine cut" tobacco products. Typically, the very finely divided tobacco particles or pieces are sized to pass through a screen of about 18 Tyler mesh, generally are sized to pass a screen of about 20 Tyler mesh, often are sized to pass through a screen of about 50 Tyler mesh, frequently are sized to pass through a screen of about 60 Tyler mesh, may even be sized to pass through a screen of 100 Tyler mesh, and further may be sized so as to pass through a screen of 200 Tyler mesh. If desired, air classification equipment may be used to ensure that small sized tobacco particles of the desired sizes, or range of sizes, may be collected. If desired, differently sized pieces of granulated tobacco may be mixed together.

The manner by which the tobacco is provided in a finely divided or powder type of form may vary. Preferably, tobacco parts or pieces are comminuted, ground or pulverized into a powder type of form using equipment and techniques for grinding, milling, or the like. Most preferably, the tobacco is relatively dry in form during grinding or milling, using equipment such as hammer mills, cutter heads, air control mills, or the like. For example, tobacco parts or pieces may be ground or milled when the moisture content thereof is less than about 15 weight percent to less than about 5 weight percent. The tobacco may also be irradiated or pasteurized.

If desired, the tobacco material may be cased and dried, and then ground to the desired form. For example, the tobacco material may be cased with an aqueous casing containing components such as sugars (e.g., fructose, glucose and sucrose), humectants (e.g., glycerin and propylene glycol), flavoring ingredients (e.g., cocoa and licorice), and the like. Non-aqueous casing components preferably are applied to the tobacco in amounts of about 1 percent to about 15 percent, based on the dry weight of the tobacco.

The tobacco formulation may incorporate other components in addition to tobacco. Those components may alter the nature of the flavor provided by that formulation. For example, those components, or suitable combinations of those components, may act to alter the bitterness, sweetness, sourness or saltiness of the formulation; enhance the perceived dryness or moistness of the formulation; or the degree of tobacco taste exhibited by the formulation. Such other components may be salts (e.g., sodium chloride, potassium chloride, sodium citrate, potassium citrate, sodium acetate, potassium acetate, and the like); natural sweeteners (e.g., fructose, sucrose, glucose, maltose, mannose, galactose, lactose, and the like); artificial sweeteners (e.g., sucralose, saccharin, aspartame, acesulfame K, neotame, and the like); combinations of natural and artificial sweeteners; organic and inorganic fillers (e.g., grains, processed grains, puffed grains, maltodextrin, dextrose, calcium carbonate, calcium phosphate, corn starch, lactose, manitol, xylitol, sorbitol, finely divided cellulose, and the like); binders (e.g., povidone, sodium carboxymethylcellulose and other modified cellulosic types of binders, sodium alginate, xanthan gum, starch-based binders, gum arabic, lecithin, and the like); pH adjusters or buffering agents (e.g., metal hydroxides, preferably alkali metal hydroxides such as sodium hydroxide and potassium hydroxide, and other alkali metal buffers such as metal carbonates, preferably potassium carbonate or sodium carbonate, or metal bicarbonates such as sodium bicarbonate, and the like); colorants (e.g., dyes and pigments, including caramel coloring and titanium dioxide, and the like); humectants (e.g. glycerin, propylene glycol, and the like); preservatives (e.g., potassium sorbate, and the like); syrups (e.g., honey, high fructose corn syrup, and the like); disintegration aids (e.g., microcrystalline cellulose, croscarmellose sodium, crospovidone, sodium starch glycolate, pregelatinized corn starch, and the like); antioxidants (e.g., ascorbic acid, grape seed extracts and oils, polyphenol-containing materials such as green tea extract and black tea extract, peanut endocarb, potato peel, and the like; see, e.g., Santhosh et al., Phytomedicine, 12(2005) 216-220, which is incorporated herein by reference); and flavorants.

Flavorants may be natural or synthetic, and the character of these flavors imparted thereby may be described, without limitation, as fresh, sweet, herbal, confectionary, floral, fruity or spice. Specific types of flavors include, but are not limited to, vanilla, coffee, chocolate/cocoa, cream, mint, spearmint, menthol, peppermint, wintergreen, eucalyptus, lavender, cardamon, nutmeg, cinnamon, clove, cascarilla, sandalwood, honey, jasmine, ginger, anise, sage, licorice, lemon, orange, apple, peach, lime, cherry, strawberry, and any combinations thereof. See also, Leffingwell et al., *Tobacco Flavoring for Smoking Products*, R. J. Reynolds Tobacco Company (1972), which is incorporated herein by reference. Flavorings also may include components that are considered moistening, cooling or smoothening agents, such as eucalyptus. These flavors may be provided neat (i.e., alone) or in a composite (e.g., spearmint and menthol, or orange and cinnamon). Representative types of components also are set forth in U.S. Pat. No. 5,387,416 to White et al.; U.S. Pat. App. Pub. No. 2005/0244521 to Strickland et al.; and PCT Application Pub. No. WO 05/041699 to Quinter et al., each of which is incorporated herein by reference.

The amount of tobacco within the tobacco formulation may vary. Preferably, the amount of tobacco within the tobacco formulation is at least about 25 percent to at least about 40 percent, on a dry weight basis of the formulation. In certain instances, the amounts of other components within the tobacco formulation may exceed about 40 percent, on a dry weight basis.

The relative amounts of the various other components within the tobacco formulation may vary. Any sweetener used most preferably is employed in amounts sufficient to provide desired flavor attributes to the tobacco formulation. When present, a representative amount of sweetener, whether an artificial sweetener and/or natural sugar, may make up at least about 1 percent to at least about 3 percent, of the total dry weight of the formulation. Preferably, the amount of sweetener within the formulation will not exceed about 40 percent, often will not exceed about 35 percent, and frequently will not exceed about 30 percent, of the total dry weight of the formulation.

A binder may be employed in amounts sufficient to provide the desired physical attributes and physical integrity to the tobacco formulation. When present, a representative amount of binder may make up at least about 1 percent to at least about 3 percent of the total dry weight of the formulation. Preferably, the amount of binder within the formulation will not exceed about 20 percent of the total dry weight of the formulation. Often, the amount of binder within a desirable formulation will not exceed about 15 percent, and frequently will not exceed about 10 percent, of the total dry weight of the formulation.

A disintegration aid may be employed in an amount sufficient to provide control of desired physical attributes of the tobacco formulation such as, for example, by providing loss of physical integrity and dispersion of the various component materials upon contact of the formulation with water (e.g., by undergoing swelling upon contact with water). When present, a representative amount of disintegration aid may make up at least about 1 percent to at least about 10 percent of the total dry weight of the formulation. Preferably, the amount of disintegration aid within the formulation will not exceed about 50 percent, and frequently will not exceed about 30 percent, of the total dry weight of the formulation.

A colorant may be employed in amounts sufficient to provide the desired visual attributes to the tobacco formulation. When present, a representative amount of colorant may make up at least about 1 percent to at least about 3 percent, of the total dry weight of the formulation. Preferably, the amount of colorant within the formulation will not exceed about 30 percent, and frequently will not exceed about 10 percent, of the total dry weight of the formulation.

A filler preferably is employed in amounts sufficient to provide control of desired physical attributes and sensory attributes to the tobacco formulation. When present, a representative amount of filler, whether an organic and/or inorganic filler, may make up at least about 5 percent to at least about 15 percent, of the total dry weight of the formulation. Preferably, the amount of filler within the formulation will not exceed about 60 percent, and frequently will not exceed about 40 percent, of the total dry weight of the formulation.

A buffering or pH adjusting agent may be employed in the tobacco formulation. When present, a representative amount of buffering or pH adjusting agent may make up at least about 1 percent to at least about 3 percent of the total dry weight of the formulation. Preferably, the amount of buffering or pH adjusting agent within the formulation will not exceed about 10 percent, and frequently will not exceed about 5 percent, of the total dry weight of the formulation.

A flavoring ingredient preferably is employed in amounts sufficient to provide desired sensory attributes to the tobacco formulation. When present, a representative amount of flavoring ingredient may make up at least about 1 percent to at least about 3 percent of the total dry weight of the formulation. Preferably, the amount of flavoring ingredient will not exceed about 15 percent, and frequently will not exceed about 5 percent, of the total dry weight of the formulation.

A salt may be employed in amounts sufficient to provide desired sensory attributes to the tobacco formulation. When present, a representative amount of salt may make up at least about 1 percent to at least about 3 percent of the total dry weight of the formulation. Preferably, the amount of salt within the formulation will not exceed about 10 percent, and frequently does not exceed about 5 percent, of the total dry weight of the formulation.

An antioxidant may be employed in the tobacco formulation. When present, a representative amount of antioxidant may make up at least about 1 percent to at least about 3 percent, of the total dry weight of the formulation. Preferably, the amount of antioxidant within the formulation will not exceed about 25 percent, and frequently will not exceed about 10 percent, of the total dry weight of the formulation. When present, a representative amount of preservative may make up at least about 0.1 percent to at least about 1 percent, of the total dry weight of the formulation.

A preservative may be employed in the tobacco formulation. Preferably, the amount of preservative within the formulation will not exceed about 5 percent, and frequently will not exceed about 3 percent, of the total dry weight of the formulation.

Representative tobacco formulations may incorporate about 25 to about 60 percent tobacco, about 1 to about 5 percent artificial sweetener, about 1 to about 5 percent colorant, about 10 to about 60 percent organic and/or inorganic filler, about 5 to about 20 percent disintegrating aid, about 1 to about 5 percent binder, about 1 to about 5 percent pH-adjusting/buffering agent, flavoring ingredient in an amount of up to about 10 percent, preservative in an amount up to about 2 percent, and salt in an amount up to about 5 percent, based on the total dry weight of the tobacco formulation. The particular percentages and choice of ingredients will vary depending upon the desired flavor, texture, and other characteristics.

The manner by which the various components of the tobacco formulation are combined may vary. The various components of the formulation may be contacted, combined, or mixed together in conical-type blenders, mixing drums, ribbon blenders, or the like. As such, the overall mixture of various components with the powdered tobacco components may be relatively uniform in nature. See also, for example, the types of methodologies set forth in U.S. Pat. No. 4,148,325 to Solomon et al.; U.S. Pat. No. 6,510,855 to Korte et al.; and U.S. Pat. No. 6,834,654 to Williams, each of which is incorporated herein by reference. Manners and methods for formulating snus-type tobacco formulations will be apparent to those skilled in the art of snus tobacco product production.

The moisture content of the tobacco formulation prior to use by a consumer of the formulation may vary. Typically, the moisture content of the tobacco formulation, as present within the pouch prior to insertion into the mouth of the user, is less than about 55 weight percent, generally is less than about 50 weight percent, and often is less than about 40 weight percent. Certain highly preferred tobacco formulations have moisture contents, prior to use, of less than about 15 weight percent, frequently less than about 10 weight percent, and often less than about 5 weight percent. For tobacco products incorporating snus-types of tobacco, the moisture content may exceed 20 weight percent, and often may exceed 30 weight percent. For example, a representative snus-type product may include tobacco at a moisture content of about 25 weight percent to about 50 weight percent, preferably about 30 weight percent to about 40 weight percent. See, for example, U.S. patent application Ser. No. 11/233,399 to Holton, et al., which is incorporated herein by reference.

The manner by which the moisture content of the formulation is controlled may vary. For example the formulation may be subjected to thermal or convection heating. As a specific example, the formulation may be oven-dried, in warmed air at temperatures of about 40° C. to about 95° C., with a preferred temperature range of about 60° C. to about 80° C. for a length of time appropriate to attain the desired moisture content. Alternatively, tobacco formulations may be moistened using casing drums, conditioning cylinders, liquid spray apparatus, ribbon blenders, and the like. Most preferably, moist tobacco formulations, such as the types of tobacco formulations employed within snus types of products, are subjected to pasteurization. Techniques for pasteurizing snus types of tobacco products will be apparent to those skilled in the art of snus product design and manufacture.

The tobacco formulation used for the manufacture of the tobacco product preferably is provided in a ground, granulated, fine particulate, or powder form. Although not strictly necessary, the tobacco formulation may be subjected to processing steps that provide a further grinding for further particle size reduction.

The pH of the formulation may vary. Typically, the pH of the formulation is at least about 6.5 and preferably about 7.5. Typically, the pH of the formulation will not exceed about 9, and often will not exceed about 8.5. A representative formulation exhibits a pH of about 6.8 to about 8.2. A representative technique for determining the pH of the formulation includes dispersing 2 g of the tobacco formulation in 10 ml of high performance liquid chromatography water, and measuring pH of the resulting suspension/solution (e.g., with a pH meter).

If desired, prior to preparation of the formulation, the tobacco parts or pieces may be irradiated, or those parts and pieces may be pasteurized, or otherwise subjected to controlled heat treatment. If desired, after preparation of all or a portion of the formulation, the component materials may be irradiated, or those component materials may be pasteurized, or otherwise subjected to controlled heat treatment. For example, a formulation may be prepared, followed by irradiation or pasteurization, and then flavoring ingredient(s) may be applied to the formulation.

The composition/construction of a moisture-permeable packet or pouch that acts as a container for use of the tobacco formulation, such as the container pouches 116, 216, 316, 416 in the embodiments illustrated in FIGS. 1-4, may be varied. Suitable packets, pouches or containers of the type used for the manufacture of smokeless tobacco products are available under the tradenames CatchDry, Ettan, General, Granit, Goteborgs Rape, Grovsnus White, Metropol Kaktus, Mocca Anis, Mocca Mint, Mocca Wintergreen, Kicks, Probe, Prince, Skruf and TreAnkrare. The tobacco formulation may be contained in pouches and packaged, in a manner and using the types of components used for the manufacture of conventional snus types of products. The pouch provides a liquid-permeable container of a type that may be considered to be similar in character to the mesh-like type of material that is used for the construction of a tea bag. Components of the loosely arranged, granular tobacco formulation readily diffuse through the pouch and into the mouth of the user.

Descriptions of various components of snus types of products and components thereof also are set forth in U.S. Pat. App. Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Derr, and U.S. Pat. App. Pub. No. 2005/0061339 to Hansson et al.; each of which is incorporated herein by reference. See, also, the types of pouches set forth in U.S. Pat. No. 5,167,244 to Kjerstad, which is incorporated herein by reference.

An exemplary pouch may be manufactured from materials, and in such a manner, such that during use by the user, the pouch undergoes a controlled dispersion or dissolution. Such pouch materials may have the form of a mesh, screen, perforated paper, permeable fabric, or the like. For example, pouch material manufactured from a mesh-like form of rice paper, or perforated rice paper, may dissolve in the mouth of the user. As a result, the pouch and tobacco formulation each may undergo complete dispersion within the mouth of the user during normal conditions of use, and hence the pouch and tobacco formulation both may be ingested by the user. Other exemplary pouch materials may be manufactured using water dispersible film forming materials (e.g., binding agents such as alginates, carboxymethylcellulose, xanthan gum, pullulan, and the like), as well as those materials in combination with materials such as ground cellulosics (e.g., fine particle size wood pulp). Preferred pouch materials, though water dispersible or dissolvable, may be designed and manufactured such that under conditions of normal use, a significant amount of the tobacco formulation contents permeate through the pouch material prior to the time that the pouch undergoes loss of its physical integrity. If desired, flavoring ingredients, disintegration aids, and other desired components, may be incorporated within, or applied to, the pouch material.

The amount of tobacco formulation contained within each pouch may vary. In smaller embodiments, the dry weight of the tobacco formulation within each pouch is at least about 50 mg to about 150 mg. For a larger embodiment, the dry weight of the tobacco formulation within each pouch preferably does not exceed about 300 mg to about 500 mg.

Each pouch/container may have disposed therein a flavor agent member. As used herein, a flavor agent member is an object containing a flavoring ingredient (as used herein, the terms "flavorant" and "flavoring ingredient" refer to substances, such as liquids or solids, that provide a concentrated release for a sensory effect such as, for example, taste, mouthfeel, moistness, coolness/heat, and/or fragrance). The object may include capsules, microcapsules, beads, pellets, rods, strands, sheets, strips, or other shaped items designed to deliver a pre-determined, concentrated amount of a flavoring ingredient to the user. For example, representative types of materials and ingredients useful for the manufacture of essentially water insoluble flavored beads, strands or pellets may be found within the filters of cigarettes available as Camel Dark Mint, Camel Mandarin Mint, Camel Spice Crema, Camel Izmir Stinger, Camel Spice Twist, Camel Mandalay Lime and Camel Aegean Spice by R. J. Reynolds Tobacco Company. The object preferably is shaped, sized, and of a texture that provides for comfortable and convenient use. Most preferably the solid object does not include beans, nibs, sticks, nuts, or other similar solids, such as food-related solids taken directly from plants, that would not provide the controlled, concentrated release of a flavorant. Preferred solid objects are synthetically formed structures rather than food-like objects. The object may be hollow with a payload in the hollow portion comprising the flavoring ingredient. The object may be solid with the flavoring ingredient incorporated into the composition forming the solid object and releasable by dissolving or disintegrating the solid object. Preferably, the flavor agent member is a hollow capsule carrying a payload comprising a flavoring ingredient. Other object configurations may be used alone or in combination with a hollow capsule. Optionally, combinations of different forms of a flavor agent member may be used to deliver combinations of different flavors or the same flavors. Each form of a flavor agent member may be tailored to provide different release characteristics of the flavoring ingredient(s) such as, for example, quick-release, delayed release, sustained release, or a combination thereof.

Preferably, at least one capsule is incorporated within each pouch. For example, as shown in the embodiment illustrated in FIG. 1, a single capsule may be incorporated within each pouch. Alternatively, and as shown in the embodiment illustrated in FIG. 2, a plurality of capsules may be included within each pouch. For example, two or more capsules may be included in each pouch, and the number of capsules in each pouch preferably is selected based upon factors including the size of the pouch, the amount and type of tobacco within the pouch, the capsule size, the desired mouthfeel, the desired sensory effect (e.g., taste, coolness/warmth), and the like. If desired, capsules of different sizes and/or of different types (e.g., differing shell materials, differing shell properties such as shape or hardness and/or differing capsule-contained components) may be incorporated within the product. In this manner, different capsules may be incorporated into the product to provide desired properties (e.g., mouthfeel, flavor, other sensory effect), and/or to provide release of encapsulated components at different times during the use of the product. For example, a first flavoring ingredient may be released from a first set of capsules upon initial introduction of the product to a user's mouth, and a second flavoring ingredient, contained in a second set of capsules, may not be released until a later time (e.g., a semi-soluble coating of the second capsules takes longer to rupture than the coating of the first capsule set).

The size and weight of each capsule may vary depending upon the desired properties it is to impart to the tobacco product. Preferred capsules are generally spherical in shape. However, suitable capsules may have other types of shapes, such as generally rectilinear, oblong, elliptical, or oval shapes. Exemplary smaller spherical capsules have diameters of at least about 0.5 mm, generally at least about 1 mm, often at least about 2 mm, and frequently at least about 3 mm. Exemplary larger spherical capsules have diameters of less than about 6 mm, and often less than about 5 mm. Exemplary smaller individual capsules weigh at least about 5 mg, often at least about 15 mg, and frequently at least about 25 mg. Exemplary larger individual capsules weigh less than about 75 mg, generally less than about 65 mg, and often less than about 55 mg.

In certain embodiments, a plurality of very small capsules, commonly referred to as "microcapsules" may be incorporated within the product. That is, at least one capsule within the tobacco product may be of a microcapsule form. The number of microcapsules within the product may vary. That is, the number of microcapsules incorporated within the product may exceed about 10, and may even exceed about 100. Exemplary microcapsules may have diameters of less than 100 microns and may have outer shells that are gelatin based, cyclodextrin based, or the like. For example, exemplary types of microcapsule technologies are of the representative type set forth in Kondo, Microcapsule Processing and Technology, ISBN 0824768574 (1979); Iwamoto et al., AAPS Pharm. Sci. Tech. 2002 3(3): article 25; and U.S. Pat. No. 3,550,598 to McGlumphy and U.S. Pat. No. 6,117,455 to Takada et al., each of which is incorporated herein by reference.

Preferably, the capsules do not incorporate any tobacco within their outer shells, or within their inner payload regions. However, if desired, other embodiments of capsules may incorporate tobacco (e.g., as finely group tobacco pieces and/or tobacco extracts) within their outer shells and/or within their inner payload regions. Preferred components of the capsule inner payload provide a desired alteration to the sensory attributes of the smokeless tobacco product such as, for example, smell, flavor, and/or mouthfeel.

The weight of the contents within the container provided by the capsule may vary. Typically, the dry weight of the tobacco within the tobacco product may be greater than the weight provided by capsule components. However, representative tobacco products may include tobacco and at least one capsule such that the weight of capsule components range from about 10 percent to about 75 percent, often about 20 percent to about 50 percent, based on the combined weight of capsule components and dry weight of tobacco.

Representative types of capsules are of the type commercially available as "Momints" by Yosha! Enterprises, Inc. and "Ice Breakers Liquid Ice" from The Hershey Company. Representative types of capsules also have been incorporated in chewing gum, such as the type of gum marketed under the tradename "Cinnaburst" by Cadbury Adams USA. Representative types of capsules and components thereof also are set forth in U.S. Pat. No. 3,339,558 to Waterbury; U.S. Pat. No. 3,390,686 to Irby, Jr. et al.; U.S. Pat. No. 3,685,521 to Dock; U.S. Pat. No. 3,916,914 to Brooks et al.; U.S. Pat. No. 4,889,144 to Tateno et al. and U.S. Pat. No. 6,631,722 to MacAdam et al.; US Pat. Pub. No. 2004/0261807 to Dube et al.; and PCT Application WO 03/009711 to Kim; which are incorporated herein by reference. See also, the types of capsules and components thereof set forth in U.S. Pat. No. 5,223,185 to Takei et al.; U.S. Pat. No. 5,387,093 to Takei; U.S. Pat. No. 5,882,680 to Suzuki et al.; U.S. Pat. No. 6,719,933 to Nakamura et al. and U.S. Pat. No. 6,949,256 to Fonkwe et al.; and U.S. Pat. App. Pub. Nos. 2004/0224020 to Schoenhard; 2005/0123601 to Mane et al.; 2005/0196437 to Bednarz et al. and 2005/0249676 to Scott et al.; which are incorporated herein by reference. The capsules may be colored, provided with smooth or rough surfaces, have rigid or pliant shells, have brittle or durable shells, or other desired features or characters.

An exemplary capsule may include an outer shell incorporating a material such as gelatin, and an inner payload region incorporating at least one flavoring ingredient and a triglyceride liquid. Exemplary types of flavoring ingredients include those set forth above with reference to the types of flavoring ingredients for the tobacco formulation. Thus, for example, such a capsule may be incorporated within the pouch along with the tobacco formulation; and during use, contact of the capsule with moisture present in the user's mouth may cause the capsule to soften, lose its physical integrity, and release the flavoring ingredients within the user's mouth. Alternatively, the capsule may be purposefully crushed by application of pressure to release the flavoring ingredients. Such a release of flavoring ingredient may alter or enhance the flavor of the product, as well as extending the period of time that a user may enjoy the product.

An exemplary capsule, such as, for example, the capsule 134 depicted in FIG. 1, may include an outer shell incorporating a material such as wax, and an inner payload incorporating an aqueous or non-aqueous liquid (e.g., a solution or dispersion of at least one flavoring ingredient within water or an organic liquid such as an alcohol or oil; or a mixture of water and a miscible liquid like alcohol or glycerin). Thus, for example, such a capsule may be incorporated within the pouch along with the tobacco formulation; and during use of the product, a crushing or other physical destruction of the capsule may allow the capsule to release the moisture contained therein to provide suitable moistening of components of the tobacco formulation. For example, a suitable number of capsules having outer shells comprising a food grade waxy substance and an inner payload comprising water may be incorporated within a pouch such that, upon rupture of those capsules, sufficient water is released to provide a desired moistening effect upon the tobacco formulation. For example, about 150 mg of a tobacco formulation having moisture content of about 8 weight percent to about 10 weight percent may be contained within a pouch containing about three water-filled capsules with outer shells comprising wax, wherein each capsule contains about 20 mg to about 30 mg of water. Exemplary types of waxes include ChevronTexaco Refined Waxes 128 and 141 (available from Chevron Corporation) and waxes produced using the wax Hydrofining process of ExxonMobil Corporation. Such a release of moistening agent from the capsules may alter or enhance the sensory attributes (e.g., flavor and organoleptic characteristics) of the product, and may also extend the time for which a user may wish to keep the product in his mouth.

If desired, other components also may be contained within each pouch. For example, at least one flavored strip, piece or sheet of flavored water dispersible or water soluble material (e.g., a breath-freshening edible film type of material) may be disposed within each pouch along with or without at least one capsule. Such strips or sheets may be folded or crumpled in order to be readily incorporated within the pouch. See, for example, the types of materials and technologies set forth in U.S. Pat. No. 6,887,307 to Scott et al. and U.S. Pat. No. 6,923,981 to Leung et al.; and The EFSA Journal (2004) 85, 1-32; which are incorporated herein by reference.

Although less preferred, at least one capsule may be enclosed within a small moisture permeable mesh pouch that is in turn contained within the outer mesh container of the smokeless tobacco product. In such an embodiment, the tobacco formulation within the pouch may be segregated from at least one of the capsules also contained within that pouch. (See, e.g., FIG. 3).

Representative tobacco products may be manufactured using appropriately modified smokeless tobacco product manufacturing equipment. For example, a representative packaging machine, such as a Packaging Machine SB 53-2/T Forming-, Filling- and Sealing Machine from Merz Verpackungsmachinen GmbH may be suitably modified with a capsule insertion apparatus of the general type set forth in U.S. patent application Ser. No. 11/234,834, filed Sep. 23, 2005 to Thomas et al., which is incorporated herein by reference.

Products of the present invention may be packaged and stored in much the same manner that conventional types of smokeless tobacco products are packaged and stored. For example, a plurality of packets or pouches may be contained in a cylindrical container. If desired, moist tobacco products (e.g., products having moisture contents of more than about 20 weight percent) may be refrigerated (e.g., at a temperature of less than about 10° C., often less than about 8° C., and sometimes less than about 5° C.). Alternatively, relatively dry tobacco products (e.g., products having moisture contents of less than about 15 weight percent) often may be stored under a relatively wide range of temperatures.

The following examples are provided to illustrate further the present invention, but should not be construed as limiting the scope thereof. Unless otherwise noted, all parts and percentages are by weight.

Example 1

A tobacco product comprising a tobacco formulation and liquid filled capsule contained in a sealed, moisture permeable mesh pouch may be assembled as follows:

Flue-cured tobacco lamina that has been aged is provided in a strip form, and at a moisture content of about 9 percent. The lamina is milled under cryogenic conditions to a fine ground form. The powder is sufficiently fine so as to pass through a 150 Tyler mesh screen. The resulting powder then is irradiated with about 5 to about 20 kilorays of gamma radiation.

The tobacco powder is introduced into a fluidized bed. While in the fluidized bed, the tobacco powder is introduced to a mixture of water and various ingredients that have been provided in a dry powder form. The resulting mixture is removed from the fluidized bed, and dried to a moisture content of about 4 percent.

The resulting tobacco formulation that is removed from the fluidized bed comprises the following: about 32 parts of the granulated flue-cured tobacco lamina, about 2 parts of sucralose (modified sugar), about 1 part titanium dioxide, about 20.5 parts calcium carbonate (in the form available as HD PPT Fine from Ruger Chemical), about 27.7 parts mannitol powder, about 2.3 parts powdered cellulose (in the form available as QC-90 from CreaFill Fibers), about 8.5 parts pregelatinized corn starch (in the form available as Starch 1500 from Colorcon), about 4.5 parts povidone (in the form available as PVPK-30 from Xian Medicines & Health Products), and about 1.5 parts potassium hydroxide. The moisture content of the resulting powdered tobacco formulation is about 4 percent. The resulting tobacco formulation is a dry, free flowing, finely milled powder that is light tan in color, and is made up of particles having an average particle size sufficient to pass through a screen of about 80 Tyler mesh.

A smokeless tobacco pouch product available as Revel Tobacco pack cinnamon by U.S. Smokeless Tobacco Co. is provided. That tobacco product includes pieces of tobacco contained within a sealed pouch. The pouch is a slim, permeable fabric packet that is treated with sweetener and cinnamon flavor. A small opening is cut in the pouch using a razor blade, and the tobacco within the pouch is removed therethrough. About 180 mg of the tobacco formulation described above is introduced into the pouch.

In addition, one spherical capsule is incorporated within the pouch. The capsule used in this example is commercially available as "Momints" from Yosha! Enterprises, Inc. Each such capsule has a diameter of about 4.5 mm, and weighs about 45 mg. A heating iron is briefly passed near the region of the cut opening to cause thermoplastic (e.g., polypropylene) components of the pouch fabric to melt. The pouch is then allowed to cool, thereby resealing it. As described above, the tobacco formulation within the sealed pouch has a loose, free-flowing, granular form and is not shaped, molded, compressed, or otherwise formed into any type of pre-determined shape.

The resulting tobacco-and-capsule product is used by placing a pouch containing the tobacco formulation in the mouth of a human subject/user. During use, saliva in the mouth of the user causes components of the tobacco formulation to pass through the water-permeable pouch and into the mouth of the human subject. At the user's choice, the capsule is breached at a desired time by physically breaking or rupturing the capsule to release its contents (e.g., by firmly pinching the pouch before placing it in the mouth or by biting the pouch gently enough not to break open the pouch but firmly enough to rupture the capsule). Most preferably, the pouch is not chewed or swallowed. The contents of the pouch most preferably are virtually all dispersed from the pouch and pass into the mouth of the human subject. The user is provided with tobacco flavor and satisfaction, and is not required to spit out any portion of the tobacco formulation. In addition, in a preferred application, the capsule undergoes substantial destruction during use of the product, and the flavored contents of the capsule are introduced into the mouth of the user with the tobacco formulation. After about 10 minutes of use/enjoyment, substantial amounts of the tobacco formulation have been ingested by the human subject, and the pouch is removed from the mouth of the human subject for disposal.

Example 2

A tobacco product comprising a snus-type tobacco formulation and a liquid filled capsule contained in a sealed, moisture permeable mesh pouch may be assembled as follows:

A smokeless tobacco product is provided, including a snus-type tobacco formulation in a sealed, slim, permeable, generally rectangular, pouch. The tobacco formulation fills the pouch such that the length is about 2.2 cm and the width is about 1.1 cm. The tobacco is a milled blend of about 50 parts flue-cured tobacco stem and about 50 parts of burley tobacco lamina. About 35 percent of the blend is sized to pass through a 50 Tyler mesh screen, about 50 percent of the blend is sized to pass through a 24 Tyler mesh screen (but not through a 50 Tyler mesh screen), and about 15 percent is sized to pass through a 18 Tyler mesh screen (but not through a 24 Tyler mesh screen). Each of the portions of the tobacco blend are ground while dry, combined, and then moistened and pasteurized. The resulting tobacco formulation incorporates about 93.5 parts tobacco having a moisture content of about 35 percent, about 2.5 parts sodium carbonate, about 2 parts propylene glycol, about 1 part sodium chloride, and about 1 part of a sweetener formulation available as SucraSweet HIS 600 from Sweetener Solutions LLC (i.e., a sweetener formulation incorporating neotame, acesulfame K and maltitol). Each pouch includes a mesh material that is a traditional snus pouch type of material. Each pouch contains about 400 mg of tobacco at about 35 percent moisture. A small opening is cut in the pouch using a razor blade. Then, one capsule is incorporated within the pouch. The capsule used in this example is commercially available as "Momints" from Yosha! Enterprises, Inc. A heating iron is briefly passed near the region of the open cut to cause a portion of the pouch wall to melt. The pouch is then allowed to cool, thereby resealing it. The tobacco formulation within the sealed pouch has a loose, free-flowing, granular form and is not shaped, molded, compressed, or otherwise formed into any type of shape. The capsule is randomly positioned within the pouch, and is in physical contact with the tobacco formulation within the pouch.

The tobacco product is used by placing one pouch containing the tobacco formulation in the mouth of a human subject/user. During use, saliva in the mouth of the user causes some of the components of the tobacco formulation to pass through the water-permeable pouch and into the mouth of the human subject. The pouch preferably is not chewed or swallowed. The user is provided with tobacco flavor and satisfaction, and is not required to spit out any portion of the tobacco formulation. In addition, the capsule undergoes destruction during use of the product, and the flavored contents of the capsule are introduced into the mouth of the user. After about 10 minutes to about 60 minutes, preferably about 15 minutes to about 45 minutes, of use/enjoyment, the contents of the capsule and substantial amounts of the tobacco formulation have been ingested by the human subject, and the pouch may be removed from the mouth of the human subject for disposal.

Example 3

A tobacco product comprising a snus-type tobacco formulation and a liquid filled capsule contained in a sealed, moisture permeable mesh pouch may be assembled as follows:

A product similar to that described with reference to Example 2 is provided, except that the capsule used is a capsule that is commercially available as "Ice Breakers Liquid Ice" from The Hershey Company, and two capsules are placed in the pouch. Each such capsule has a diameter of about 5 mm.

Example 4

A tobacco product comprising a tobacco formulation and a liquid filled capsule contained in a sealed, moisture permeable mesh pouch may be assembled as follows:

A product similar to that described with reference to Example 1 is provided, except that the pouch additionally contains at least one water soluble or dispersible flavored strip material. For example, two flavored strips of a product that is commercially available in Listerine Cool Mint PocketPaks from Pfizer, Inc are introduced into the pouch along with the capsule. The strips may dissolve to release a flavor during use.

It is intended that the foregoing detailed description be regarded as illustrative rather than limiting. It is also intended that it be understood the following claims, including all equivalents, are intended to define the spirit and scope of this invention.

We claim:

1. A smokeless tobacco product configured for insertion into the mouth of a user of that product, the tobacco product comprising:

an outer water-permeable mesh first pouch containing a tobacco formulation, the tobacco formulation including granular tobacco wherein the mesh of the first pouch comprises at least one flavoring agent, and is configured to allow passage therethrough of granular tobacco that is sized to pass through a screen of 200 Tyler mesh;

an inner water-permeable second pouch, the second pouch disposed within, but separate from the outer first pouch, the second pouch containing at least one flavor agent member selected from the group consisting of at least one capsule, wherein the at least one capsule comprises a rupturable outer capsule coating that surrounds and contains at least one flavoring ingredient, but not incorporating tobacco, a dissolvable strip comprising a flavoring ingredient, but not incorporating tobacco, and a combination thereof.

2. The tobacco product of claim 1 wherein at least one of the first and second pouch is soluble in water, dispersible in water, or a combination thereof.

3. The tobacco product of claim 1, comprising a sweetener selected from the group consisting of: fructose, sucrose, glucose, maltose, mannose, galactose, lactose, sucralose, saccharin, aspartame, and acesulfame K.

4. The tobacco product of claim 1 wherein the tobacco formulation includes a filler material.

5. The tobacco product of claim 4 wherein the filler material is selected from the group consisting of grains, maltodextrin, dextrose, calcium carbonate, calcium phosphate, corn starch, lactose, manitol, xylitol, sorbitol, and finely divided cellulose.

6. The tobacco product of claim 1 wherein the granular tobacco is sized to pass through a screen of 18 Tyler mesh.

7. The tobacco product of claim 1 wherein the granular tobacco is sized to pass through a screen of 20 Tyler mesh.

8. The tobacco product of claim 1 wherein the granular tobacco is sized to pass through a screen of 50 Tyler mesh.

9. The tobacco product of claim 1 wherein the granular tobacco is sized to pass through a screen of 200 Tyler mesh.

10. The tobacco product of claim 1, wherein the tobacco formulation comprises at least one flavoring ingredient.

11. The tobacco product of claim 10, wherein the flavoring ingredient is comprised by a liquid carrier.

12. The tobacco product of claim 10, wherein the flavoring ingredient imparts a flavor selected from the group consisting of vanilla, coffee, chocolate, cream, mint, spearmint, eucalyptus, menthol, peppermint, wintergreen, lavender, cardamon, nutmeg, cinnamon, clove, cascarilla, sandalwood, honey, jasmine, ginger, anise, sage, licorice, lemon, orange, apple, peach, lime, cherry, strawberry, and any combination thereof.

13. The tobacco product of claim 1, wherein a rupture of the outer capsule coating exposes the inner capsule region to the tobacco formulation.

14. The tobacco product of claim 1, wherein the outer capsule coating comprises wax, gelatin, or cyclodextrin.

15. The tobacco product of claim 1, wherein the at least one capsule comprises a plurality of capsules.

16. The tobacco product of claim 15, wherein the plurality of capsules comprises capsules of different sizes.

17. The tobacco product of claim 1, wherein the at least one capsule is generally spherical and has a diameter between about 0.5 mm and about 6 mm.

18. The tobacco product of claim 11, wherein the liquid carrier is selected from water, an organic liquid, and a combination thereof.

* * * * *